US007043787B2

(12) United States Patent
Sato et al.

(10) Patent No.: US 7,043,787 B2
(45) Date of Patent: May 16, 2006

(54) FLUID BEDDING

(76) Inventors: Kazuhiro Sato, 43-6, Sawatari Kanagawa-ku, Yokohama-shi, Kanagawa 221-0844 (JP); Yasayuki Fujimura, 6-14-26 Kotsubo, Zushi-shi, Kanagawa 249-0008 (JP); Teruo Kimura, deceased, late of Nitta-machi (JP); by Shizuko Kimura, legal representative, 528-1, Oaza Murata, Nitta-machi, Nitta-gun, Gunma 370-0312 (JP); by Mitsuhiro Kimura, legal representative, 528-1, Oaza Murata, Nitta-machi, Nitta-gun, Gunma 370-0312 (JP); by Yosuke Kimura, legal representative, #605, Castle Noge-chou, 1-52, Noge-machi, Yokohama 231-0064 (JP)

( * ) Notice: Subject to any disclaimer, the term of this patent is extended or adjusted under 35 U.S.C. 154(b) by 0 days.

(21) Appl. No.: 10/480,532

(22) PCT Filed: Jun. 11, 2002

(86) PCT No.: PCT/JP02/05774

§ 371 (c)(1),
(2), (4) Date: Dec. 1, 2004

(87) PCT Pub. No.: WO02/102206

PCT Pub. Date: Dec. 27, 2002

(65) Prior Publication Data

US 2005/0150054 A1 Jul. 14, 2005

(30) Foreign Application Priority Data

Jun. 14, 2001 (JP) ..... 2001-179762

(51) Int. Cl.
*A47C 27/10* (2006.01)

(52) U.S. Cl. ..... 5/682; 5/665; 5/644; 5/709; 5/655.5

(58) Field of Classification Search ..... 5/680, 5/682, 665, 644, 655.5, 709
See application file for complete search history.

(56) References Cited

U.S. PATENT DOCUMENTS

| | | | | | |
|---|---|---|---|---|---|
| 3,689,949 | A | * | 9/1972 | Weinstein et al. | 5/680 |
| 3,872,525 | A | * | 3/1975 | Lea et al. | 5/671 |
| 4,245,361 | A | * | 1/1981 | Evanson | 5/680 |
| 4,532,662 | A | * | 8/1985 | Sama | 5/680 |
| 4,912,789 | A | * | 4/1990 | Maxwell | 5/680 |
| 5,210,892 | A | * | 5/1993 | Johenning et al. | 5/677 |

FOREIGN PATENT DOCUMENTS

| | | | |
|---|---|---|---|
| JP | 59-70559 | U | 5/1984 |
| JP | 1-177953 | U | 12/1989 |
| JP | 9-19346 | A | 1/1997 |
| JP | 2001-54447 | A | 2/2001 |

* cited by examiner

*Primary Examiner*—Alexander Grosz
(74) *Attorney, Agent, or Firm*—Venable, LLP; Michael A. Sartori; Kavita B. Lepping

(57) ABSTRACT

The bedding of the present invention comprises a sealed bag body having an elastic body with a plurality of continuous pores and gas sealed with looseness present in the upper part of the elastic body. The bedding also includes a water-sealed bag body disposed on an upper part of the bag body, the water-sealed bag body having an elastic body with a plurality of continuous pores and liquid sealed therein. The elastic body within the water-sealed bag body has upper and lower parts having looseness. This claimed bedding capable of providing comfortable sleep can be realized by uniformly supporting a human body, with the buoyancy of the liquid while reducing the amount of the liquid required therein.

15 Claims, 5 Drawing Sheets

FLUID BEDDING

TECHNICAL FIELD

The present invention relates to a piece of bedding, which comfortably supports a head or an entire body during a sleep.

BACKGROUND ART

Conventionally, fluid filled bedding includes air filled bedding (e.g. air mattresses, air pillows) and fluid filled bedding (e.g. waterbed and water pillows), are available.

A conventional air mattress and air pillow support a human body mainly with tension of an air-sealed bag (bag body). However, pressure generated by the tension of a bag body and supports the human body, is extremely uneven in different regions, depending on the shape of the part of the human body the bag is supporting. The pressure also widely varies depending on the state of contact between the bag body and the human body. Accordingly, the bedding fails to consistently support the human body with uniform pressure, resulting in uncomfortable sleep.

In the conventional waterbed and water pillow with no frame, in order to maintain the shape of the bedding, an approximately equivalent amount of water corresponding to the maximum volume of the inner space of the water-sealed bag body has to be filled therein. Since a large ratio of the force supporting the human body is tension working on the bag, comfortable sleep is not obtained.

One prior art solution is a technique to maintain the shape of the bedding while reducing the volume of the fluid-sealed bag body therein. Specifically, a bedding having an elastic body with continuous air bubbles formed into a desired shape is inserted in the bag body. The surface of the elastic body and the inner surface of the bag body are all bonded to each other so as to maintain the shape as bedding. However, since the bag body is bonded to the elastic body via the surfaces thereof, there is not enough flexibility to deform freely. Therefore, when the human body is supported, a high ratio of the tension of the bag body in the force of supporting the human body is created.

Another current solution to reduce the ratio of the tension in the force supporting the human body is by creating a looseness in the water-sealed bag at where the bag comes into contact with the human body. To maintain the configuration as bedding, a part of the bag is formed of a solid material, or the periphery of the bag is enclosed with a solid material. Though almost all force of the human body is born by buoyancy, this technique is only practical in a large bed where the solid portion does not come into contact with the human body. Furthermore, to obtain enough buoyancy, liquid of considerable depth has to be sealed inside the bed. Accordingly, the bed is very heavy, making it difficult to install.

As described above, no conventional bedding comfortably supports a head or an entire body by means of buoyancy at a constant pressure, nor being light in weight, small in size, and inexpensive in cost.

SUMMARY OF THE INVENTION

The present invention has been proposed in view of the above problems. The present invention overcomes the problems present throughout the art by comfortably supporting a head or an entire body by means of buoyancy at a constant pressure, is lightweight, small in size, and inexpensive.

According to the present invention, a bag body for containing fluid includes an elastic body with a plurality of continuous pores, such as a sponge with continuous air bubbles. Portions in an inner surface of the bag body corresponding to side surfaces of the bedding are bonded to the elastic body. Thus it is possible to maintain a shape as bedding even when the amount of water sealed in the bag body is less than the volume of a space formed in the bag. As a result, it is possible to provide appropriate looseness or slack to the bag body at a portion of the bedding where a human body is supported, reducing tension in the bag body that supports the human body.

Also, elastic body portions in the bag body which come into contact with the human body via interposed bag skin, generate elastic forces. In some cases, a problem arises where pressure generated on the human body varies significantly between portions where the human body is in contact with the bag body and where the human body is not in contact. This problem is overcome in the present invention by using an elastic body with countless continuous pores. That is, since the countless continuous pores are filled with liquid, even the portion bent down by the pressure from the human body can generate buoyancy of the liquid.

Liquid viscosity can reduce elastic force, preventing restoration of the bent portion to its original shape. However, in the present invention, elastic forces required to maintain the shape (such as along the side of the bedding) are obtained while the elastic force in the vertical direction is eliminated; thus the human body can be supported uniformly by means of the buoyancy.

Another problem in the art is that, as the weight of the human body to be supported increases, the amount of liquid required for obtaining sufficient buoyancy is also increased. This difficulty is solved by forming a thin bag body filled with the liquid and the elastic body, and also forming a thick bag filled with gas and the elastic body therein, and placing the thick bag under the thin bag. As a result of the looseness of the two bag bodies, gas is able to redistribute such that both elastic bags (the thin water-filled bag and the thick gas-filled bag) are able to move together in response to downward force (such a human body). The amount of the movement exhibited by the bags corresponds to the distribution of the load applied thereto. Both of the liquid and the gas work to maintain a constant volume. The non load-bearing area is deformed into a convex portion, and the difference between the convex portion and the concave portion results in a depth of water generating buoyancy of the water proportional to the depth of the water. By utilizing the above, a piece of light bedding in which the required amount of the liquid is largely reduced as compared to the conventional fluid bedding is achieved.

BEST MODE FOR CARRYING OUT THE INVENTION

Figure 1:
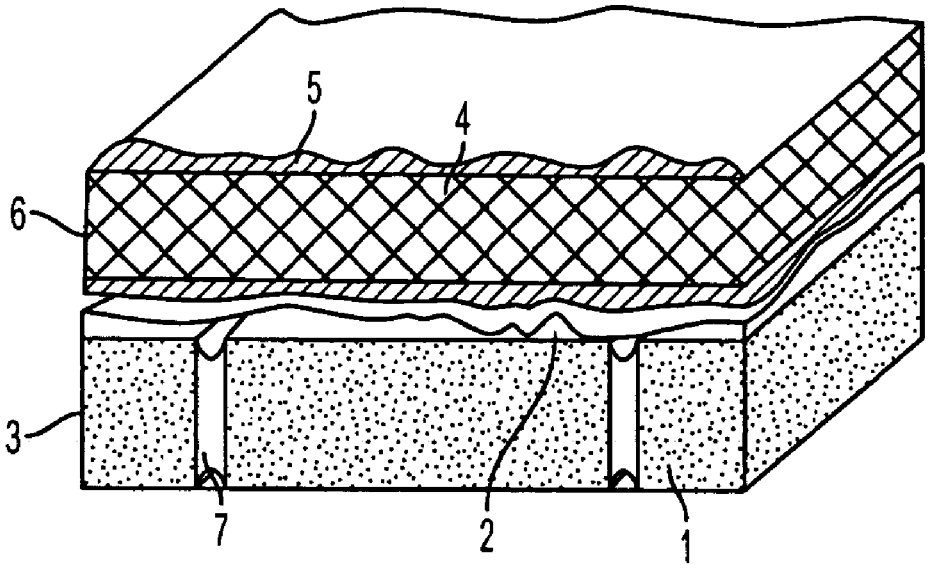
FIG. 1 illustrates the fluid bedding according to one embodiment of the present invention.

FIG. 1 illustrates the fluid bedding according to one embodiment of the present invention. The bedding includes a sealed bag body 3 containing an elastic body 1 with a plurality of continuous pores and gas 2 sealed within the bag body 3, the bag body 3 having an upper part with looseness. A water-sealed bag body 6 is disposed on the upper part of the bag body 3, the water sealed bag body 6 containing an elastic body 4. The elastic body 4 has a plurality of continuous pores and liquid 5 sealed therein. The elastic body 4 has upper and lower parts both having looseness.

Figure 2:
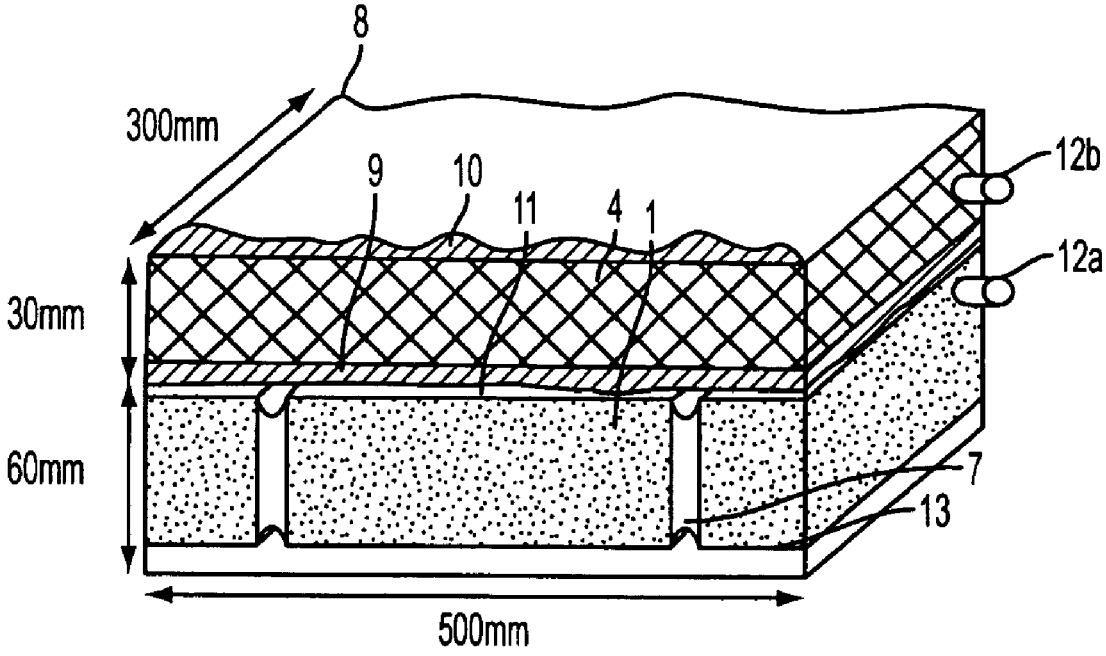
FIG. 2 is a illustrates the fluid bedding according to one embodiment of the present invention.

FIG. 2 shows a pillow, which is a mode of an embodiment of the present invention. A rectangular parallelepiped bag body 8, which is 300 mm in longitude, 500 mm in transversal and 110 mm in height, is formed of a polyvinyl chloride sheet. At a position 60 mm away from the bottom face, an interior of the rectangular parallelepiped is partitioned by a partition 9 made of a polyvinyl chloride sheet into an upper part and a lower part. Sealed in the upper part is water 10, and sealed in the lower part is air 11. Provided to the lower part of the rectangular parallelepiped bag body is a valve 12*a* for injecting or discharging air, and provided to the upper part thereof is a valve 12*b* for injecting or discharging the water. Also, a shape obtained by projecting the partition 9 on a horizontal plane is the same rectangular shape as that obtained by projecting the rectangular parallelepiped on the horizontal plane. The partition 9 is provided with looseness so that the sealed water and the air are allowed to appropriately and freely change the shape. An area of the partition 9 is approximately 1664 $cm^2$. A water volume of approximately 4500 $cm^3$, which is equivalent to the depth of approximately 3 cm at ambient temperature, is sealed therein. The air volume of approximately 9000 $cm^3$ under 1 atmosphere pressure at ambient temperature is sealed. Disposed in a space of the upper part of the bag body 8 is an elastic body 4 with continuous air bubbles, which has a rectangular parallelepiped shape with external dimensions of 30 mm in longitude, 50 mm in transversal and 30 mm in height respectively. The inner surface of the bag body and the side surfaces of the elastic body are joined to each other. Disposed in a space of the lower part of the bag body 8 is an elastic body 1 with continuous air bubbles, which has a rectangular parallelepiped shape with external dimensions of 300 mn in longitude, 500 mm in transversal and 60 mm in height. The inner surface of the bag body 8 and the side surfaces of the elastic body are joined to each other. The elastic body 1 has a function such that, even when a load is applied to the pillow causing the gas to be partially displaced, the shape as the pillow is maintained, and when the load is removed, the original shape thereof is restored swiftly. Further, the bag body is ordinarily formed with a flexible material. The distance between the molecules of such substance is larger than the molecule of the gas. The gas sometimes escapes from the interior to the outside during a long period of time. Even in such case, the elastic body 1 has an elastic force in directions that the bag body is expanded and thus the elastic body 1 has a function to intake the air from the outside. Furthermore, on the surfaces and in the interior of the elastic body 1, a plurality of paths 7 is formed so that the gas moves swiftly within the interior of the elastic body 1. Even when a load is applied to the pillow, to prevent the path 7 from collapsing, the lower part of the elastic body 1 is also formed with an elastic body 13 having an elasticity larger than the elastic body 1, whereby the gas can move swiftly within the space in the lower portion of the bag body 8. FIG. 3 shows some examples of such paths.

Figure 3A:
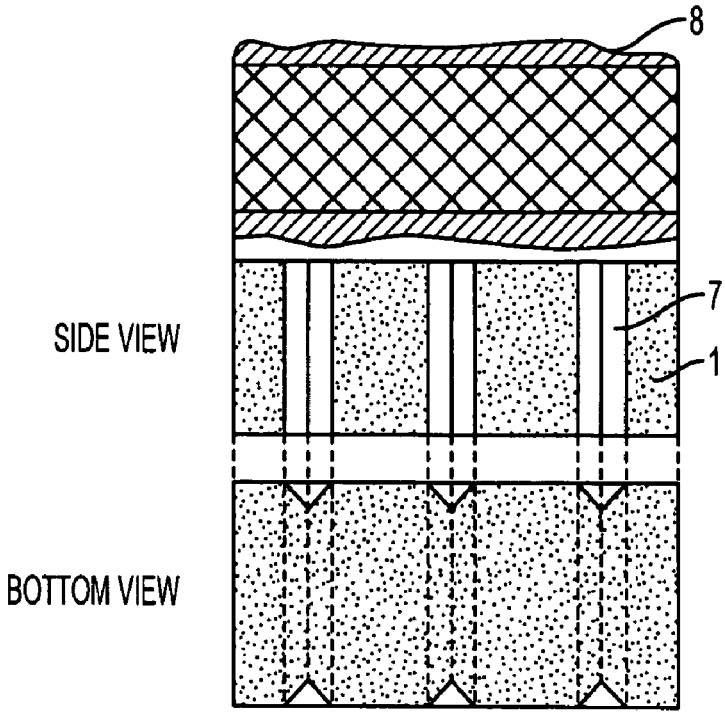
FIGS. 3*a*–3*c* illustrates paths for gas in a fluid bedding according to one embodiment of the present invention.
Figure 3B:
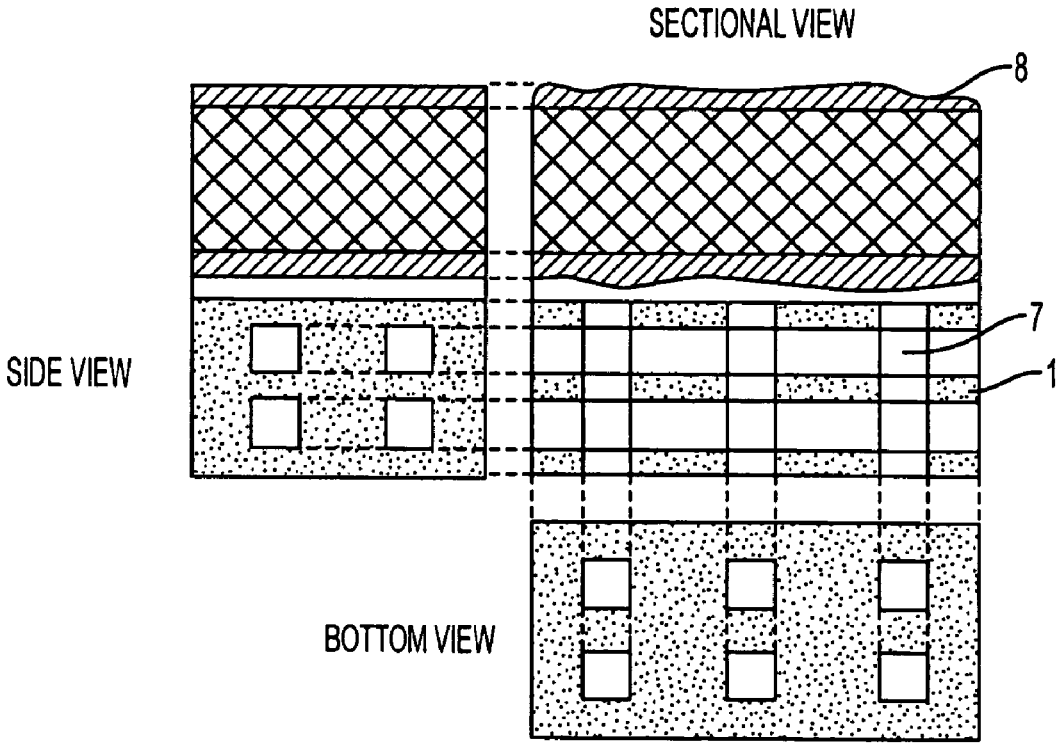
Figure 3C:
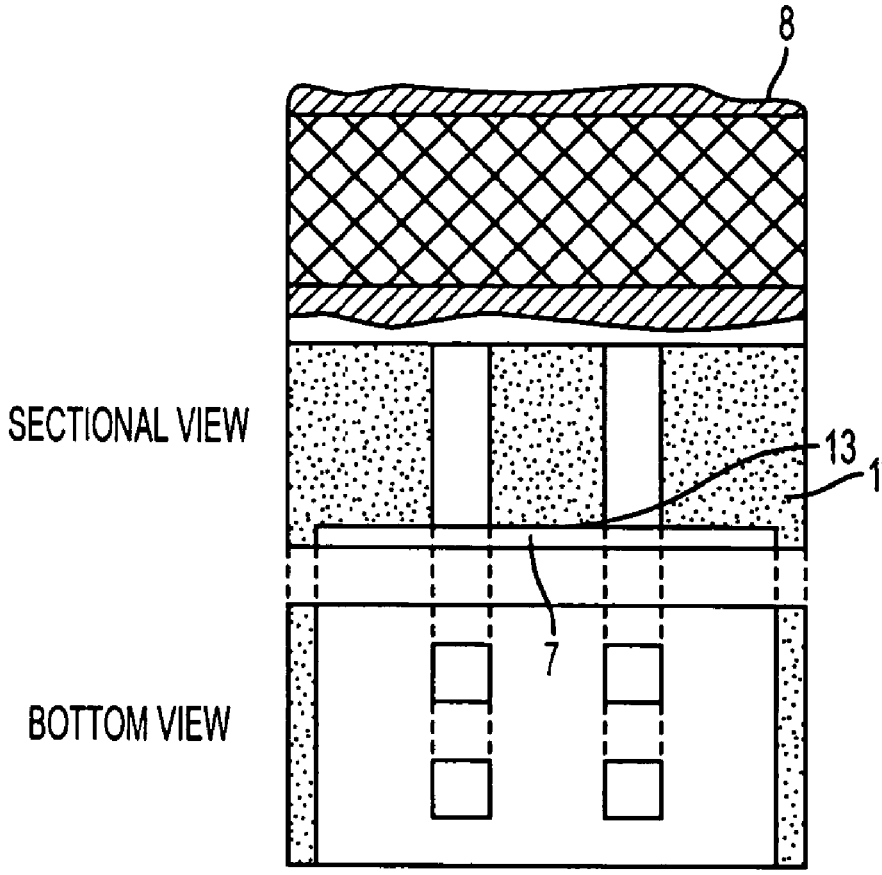

FIG. 3*a* shows an example in which paths 7 are formed in the surface of the elastic body so that the gas can readily move along the paths. FIG. 3*b* are views showing an example, in which the paths 7 are formed inside the elastic body, viewed in a section of the elastic body. When the paths 7 are formed inside the elastic body, an effect such that the gas, which resides in a position away from the surface thereof, can readily move is obtained. FIG. 3*c* shows an example in which, using an elastic body 13 having a larger degree of elasticity than the elastic body 1, path 7 is formed in the lower part of the elastic body 1. By forming the path using a material slightly harder than the elastic body 1, when a load is applied to the pillow, it is possible to reduce the extent of deformation of the path due to the oppression. By connecting these paths to the paths formed inside the elastic body 1, it is possible to allow the gas to move more easily. Also, the paths in the example shown in FIG. 3 may be combined with each other in respective portions of the elastic body.

By adopting the structure as described above, while maintaining the rectangular parallelepiped shape of approximately 300 mm in longitude, 500 mm in transversal and 90 mm in height, the pillow provides an appropriate looseness to the surface which comes into contact with a human head. Accordingly, compared to a so-called water pillow, which is fully filled with water sealed therein, the pressure due to the tension of the surface of the bag body out of pressure, which is generated against the human head when the human head is placed thereon, is satisfactorily reduced in the present invention. The elastic body positioned in the space of the upper part of the rectangular parallelepiped generates an elastic force against the human head immediately after the human head is placed on the elastic body. However, since the water contained in countless pores always supports the human head, when an elastic body with a small elastic force is used, the influence thereof is reduced. Further, the elastic body, which has been once compressed in the water, has to expand against a frictional force given by the water due to the water viscosity. When the head is placed, the elastic force of the elastic body, which is in a stationary state being compressed, is approximately the same as a maximum static friction force. Accordingly, compared to the pressure due to the buoyancy of the water, the pressure due to the elastic force of the elastic body out of the pressure, which is generated against the head, is satisfactorily restrained.

Figure 4:
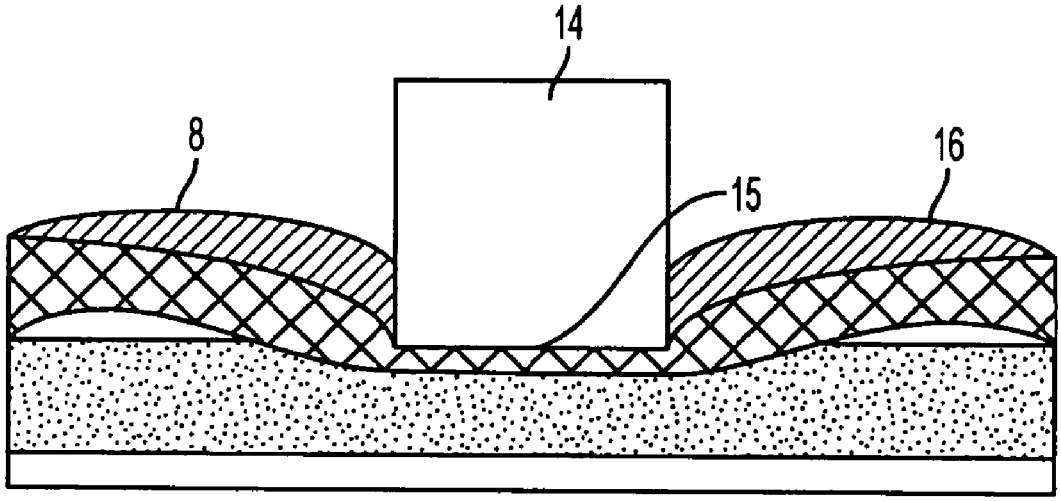
FIG. 4 illustrates a manner in which the fluid bedding supports a human body according to one embodiment of the present invention.

A state where a human head is placed on the pillow of the embodiment will be described below with reference to FIG. 4. FIG. 4 is a sectional view showing a state where a cube 14 of 100 mm in longitude, 100 mm in transversal and 100 mm in height, which is used to resemble a human head, is placed on the pillow according to the present invention. The depth of the water in the upper part of the rectangular parallelepiped is approximately 30 mm. For example, in the case of a head having a volume equivalent to the cube and a mass of approximately 6 kg, to completely support the head with the buoyancy only, water of approximately 60 mm in depth is required. In this embodiment, since a satisfactory looseness is provided to the upper part of the bag body, which contains liquid sealed therein, the cube can sink up to a certain depth while receiving little tension of the bag body. In this process, the water is pushed aside to the surrounding area and the elastic body in the water is pressed downward. Accordingly, the bottom face 15 of the cube lowers lower than the bottom face of the water without the cube, and the bottom face 15 of the cube sinks up to a position 2 cm lower than the bottom face of the water without the cube. Further, the elastic body in the water is pressed downward by the bottom face of the cube, and the gas under the bottom face of the cube also moves to the surrounding area. Since the volume of the gas changes little due to such load, in the surrounding area to which the gas shifts, the bag body containing the gas expands and pushes up water in the upper part thereof. As a result, the water level of this area is raised. As shown at a peak 16, compared to the case of no load, the water level is raised up to approximately 1 cm higher at the highest portion. Thus, although the actual depth of water is 3 cm, it is possible to render an effect of the buoyancy to the cube same as the case where the cube is placed in the water of substantially 6 cm in depth.

Figure 5:
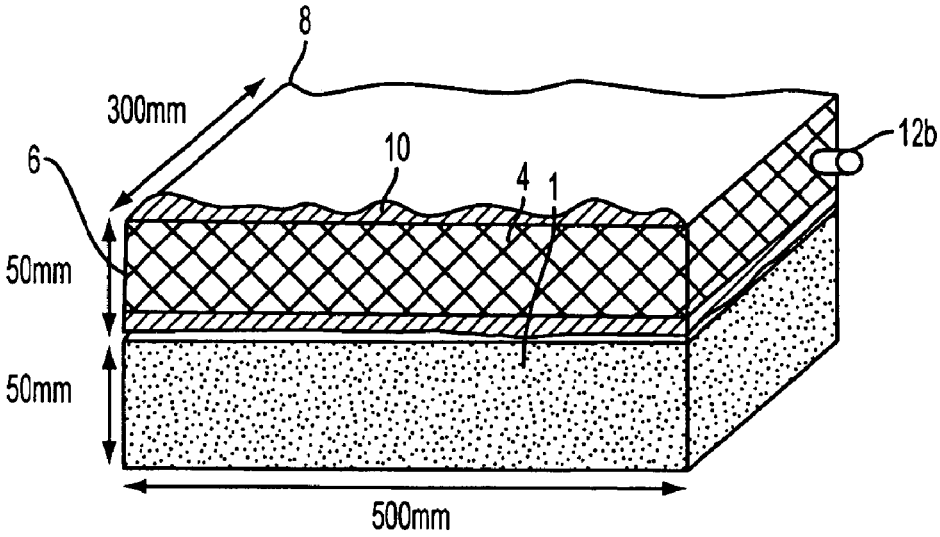
FIG. 5 is an explanatory view showing a manner of embodying the fluid bedding.

FIG. 5 shows another embodiment of the present invention. A rectangular parallelepiped bag body 6 of 300 mm in longitude, 500 mm in transversal and 70 mm in height is formed of a polyvinyl chloride sheet. Attached to the bag body 6 is a valve 12*b* for injecting and discharging water, and water 10 of 75000 $cm^3$ is injected therein. Also, provided inside the bag body is an elastic body 4 of 300 mm in longitude, 500 mm in transversal and 50 mm in height with continuous air bubbles. The side surfaces of the elastic body 4 are bonded with the inner surface of the vinyl sheet. Disposed in the lower part of the bag body 6 and being bonded therewith is elastic body 1 of 300 mm in longitude, 500 mm in transversal and 50 mm in height with continuous air bubbles. Similar to the previously described embodiment, when a cube of 100 mm in longitude, 100 mm in transversal and 100 mm in height and 6 kg in mass is placed on the pillow, compared to the state of no cube thereon, the water level is raised by approximately 3 mm, and the bottom face of the cube sinks up to a position approximately 4 mm lower than the bottom face of the water with no cube. In this case, it is possible to render substantially the same buoyancy as the case when the cube is placed in the water of approximately 5.7 cm in depth.

By adopting the structure as described above, compared to the previous embodiment, the air-sealed bag body is not required, resulting in a simple structure. Also, there is no possibility of deterioration in the performance thereof due to air leakage. However, when a load is applied to the pillow, in the portion to which the load is applied, the elastic body in the water is pressed downward. Accompanying this, the corresponding portion of the elastic body, which is disposed under the bag body, is also pressed downward. Even when the air in that portion escapes to the surrounding area, there is no upward force on the non-load-bearing portion of the pillow. Therefore it is necessary to increase the depth of the initially sealed water, compared to the previous embodiment, to obtain the same buoyancy. Accordingly, there resides such problem that the weight of the pillow becomes slightly heavier.

Figure 6A:
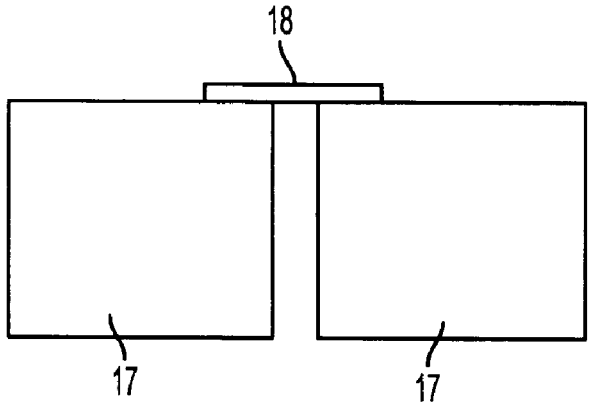
FIGS. 6*a*, 6*b* illustrate an additional embodiment of the fluid bedding of the present invention.

FIG. 6 shows an example in which bag bodies according to the above-described embodiments are connected to each other, thereby a piece of bedding is formed. Reference numeral 17 in FIG. 6 denotes, respectively, bag bodies according to the above-described embodiments. FIG. 6*a* is a view showing an example viewed from the side thereof, in which the upper parts of the bag bodies formed of polyvinyl chloride are joined to each other with a joint portion 18 formed of polyvinyl chloride. The polyvinyl chloride constituting the upper part of the bag bodies may be formed integrally with a plurality of bag bodies. The bag bodies 17 are made up of small-sized members, and the fluid inside the bag body is independent in each bag body. Even when a bag body is suffered from breakage or the like, only the fluid in the bag body perforated with a hole flows out. In the case of such accident, it is possible to restrict the damage within a small range.

Figure 6B:
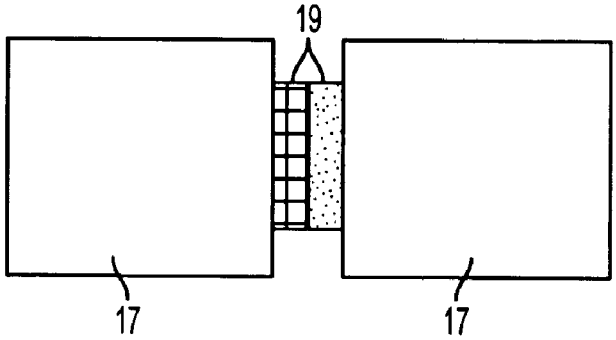

FIG. 6*b* is a view showing an example viewed from the side, in which joint portions, for example, detachable Velcro fastenings 19 are provided to the side surface of the bag bodies, and the bag bodies are detachably connected to each other. Arranging each of the bag bodies to be detachable makes for easy carriage, and components can be rearranged to adapt to the space in which they are used, to the person who uses them, and for a particular use.

Figure 7A:
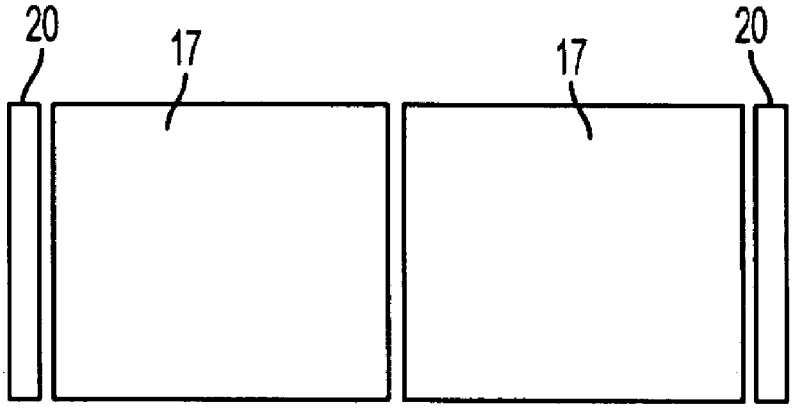
FIGS. 7*a*, 7*b* illustrate a further embodiment of the fluid bedding of the present invention.
Figure 7B:
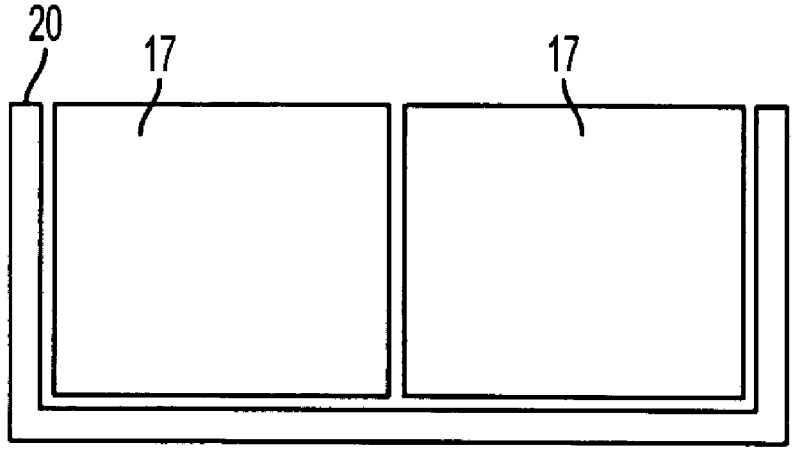

FIG. 7 shows examples of bag bodies 17 according to the above embodiments which are enclosed with a frame 20. By enclosing with the frame, the shape of the bag bodies can be maintained more easily. It is also possible to form a plurality of small-sized bag bodies and dispose them inside the frame without connecting them to each other. FIG. 7*a* is a sectional view showing an example having a frame, which encloses the side surfaces only. FIG. 7*b* is a sectional view showing an example having a frame, which has the side surfaces and a bottom face connected to each other continuously to form a frame. In this case, even when the liquid in the bag body flows out due to tear damages of the bag body or the like, the liquid stays inside the frame; thus, it is possible to prevent the liquid from spreading out in a room where the bedding is placed.

In the above embodiments, the pillow has been mainly described as an example. However, the present invention is not limited to the pillow, but is applicable to a variety of purpose for supporting human body such as a bed, a chair, a sofa, a cushion or the like.

INDUSTRIAL APPLICABILITY

A bedding using fluid that is able to support a human body using mainly the buoyancy of the fluid, is claimed. Since the fluid required for supporting the human body is largely reduced, light-weighted bedding, which can be placed anywhere, is achieved. Additionally, the structure can be adapted such that the fluid is not enclosed with a solid matter. Further, even in the case of a large size like a bed, light weight, small size, inexpensive, and comfortable bedding is achieved.

What is claimed is:

1. A bedding comprising:

a sealed bag body containing a first elastic body having a plurality of continuous pores and gas sealed within the first elastic body, the sealed bag body comprising an upper part having looseness; and a water-sealed bag body adjacent to the upper part of the sealed bag body, the water-sealed bag body containing a second elastic body having a plurality of continuous pores and liquid sealed within the second elastic body, the water-sealed bag body comprising an upper part having looseness and a lower part having looseness;

wherein the looseness allows the liquid inside the water-sealed bag body to buoyantly support a weight on the bedding without generating tension on the upper part of the sealed bag body and the upper and lower parts of the water-sealed bag body, wherein the elastic bodies are respectively bonded to the bag bodies to maintain a shape of the bedding without use of a frame, while providing looseness to the bag bodies.

2. The bedding claim 1, wherein the elastic bodies each have sides bonded to the respective bag bodies.

3. The bedding of claim 1, further comprising paths that are independent from each other or continuous with each other on a surface or interior portion of the first elastic body, the second elastic body, or the first and second elastic bodies.

4. A bedding comprising a plurality of the beddings of claim 1 connected together.

5. The bedding of claim 4, wherein the plurality of the beddings are small in size compared to the bedding.

6. A bedding comprising:

a first elastic body having a plurality of continuous pores, the first elastic body having an upper part; and a water-sealed bag body adjacent to the upper part of the elastic body, the water-sealed bag body containing a second elastic body having a plurality of continuous pores and liquid sealed within the second elastic body, the water-sealed bag body comprising an upper part having looseness and a lower part having looseness, wherein the looseness allows the liquid inside the water-sealed bag body to buoyantly support a weight on the bedding without generating tension on the upper and lower parts of the water-sealed bag body, wherein the second elastic body is bonded to the water-sealed bag body to maintain a shape of the bedding without use of a frame, while providing looseness to the water-sealed bag body.

7. The bedding of claim 6, wherein the second elastic body has sides bonded to the water-sealed bag body.

8. The bedding of claim 6, further comprising paths that are independent from each other or continuous with each other on a surface or interior portion of the first elastic body, the second elastic body, or the first and second elastic bodies.

9. A bedding comprising a plurality of the beddings of claim 6 connected together.

10. The bedding of claim 9, wherein the plurality of the beddings are small in size compared to the bedding.

11. A bedding comprising:

a sealed bag body having a liquid-sealed upper part containing a first elastic body and liquid, a sealed lower part containing a second elastic body and air, and a partition separating the upper and lower parts, the upper part and the partition having looseness, wherein the looseness allows liquid inside the liquid-sealed upper part of the sealed bag body to buoyantly support a weight on the bedding without generating tension on the upper part and the partition of the sealed bag body, wherein the first and second elastic bodies are bonded to the sealed bag body to maintain a shape of the bedding without use of a frame, while providing looseness to the sealed bag body.

12. The bedding of claim 11, wherein the first elastic body has sides bonded to the sealed bag body.

13. The bedding of claim 11, further comprising paths that are independent from each other or continuous with each other on a surface or interior portion of the elastic body.

14. A bedding comprising a plurality of the beddings of claim 11 connected together.

15. The bedding of claim 14 wherein the plurality of the beddings are small in size compared to the bedding.

* * * * *